US006629498B1

(12) United States Patent
Marquis

(10) Patent No.: US 6,629,498 B1
(45) Date of Patent: Oct. 7, 2003

(54) PROXIMITY SUBMUNITION FUZE SAFETY LOGIC

(75) Inventor: Eugene E. Marquis, LaPlata, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/143,174

(22) Filed: May 10, 2002

(51) Int. Cl.[7] ..... F42C 9/00; F42C 21/00; F23Q 21/00; F23Q 7/02

(52) U.S. Cl. ..... 102/215; 102/200; 102/206; 102/276

(58) Field of Search ..... 102/200, 206, 102/215, 276

(56) References Cited

U.S. PATENT DOCUMENTS

| | | | | | |
|---|---|---|---|---|---|
| 3,742,857 | A | | 7/1973 | Scmidt et al. | 102/70.2 GA |
| 4,254,475 | A | * | 3/1981 | Cooney et al. | 364/900 |
| 4,421,030 | A | | 12/1983 | DeKoker | 102/218 |
| 4,454,815 | A | | 6/1984 | Beck | 102/206 |
| 4,541,341 | A | * | 9/1985 | Fowler et al. | 102/215 |
| 4,580,498 | A | | 4/1986 | Abt et al. | 102/215 |
| 4,674,047 | A | * | 6/1987 | Tyler et al. | 364/423 |
| 4,825,766 | A | | 5/1989 | Ruthen | 102/215 |
| 4,882,993 | A | | 11/1989 | Schwartzman | 102/218 |
| 4,972,775 | A | * | 11/1990 | Hoyt et al. | 102/211 |
| 5,271,327 | A | | 12/1993 | Filo et al. | 102/207 |
| 5,390,604 | A | * | 2/1995 | Ingersoll | 102/211 |
| 5,473,986 | A | * | 12/1995 | Hau | 102/206 |
| 5,520,115 | A | | 5/1996 | Braun | 102/215 |
| 5,585,592 | A | | 12/1996 | Stearns et al. | 102/233 |
| 5,591,935 | A | | 1/1997 | Shamblen et al. | 102/500 |
| 5,705,766 | A | * | 1/1998 | Farace et al. | 102/215 |
| 5,859,383 | A | | 1/1999 | Davison et al. | 102/307 |
| 5,912,428 | A | | 6/1999 | Patti | 102/215 |
| 5,942,714 | A | | 8/1999 | Oberlin et al. | 89/6.5 |
| 6,142,079 | A | | 11/2000 | Diorio | 102/215 |
| 6,145,439 | A | | 11/2000 | Ziemba | 102/266 |
| 6,247,408 | B1 | * | 6/2001 | Andrejkovies et al. | 102/200 |
| 6,295,932 | B1 | * | 10/2001 | Kane, III | 102/221 |

* cited by examiner

*Primary Examiner*—Charles T. Jordan
*Assistant Examiner*—H. A. Blackner
(74) *Attorney, Agent, or Firm*—Matthew J. Bussan, Esq,; James B. Bechtel, Esq.; John P. McMahon, Esq.

(57) ABSTRACT

The Fuze Safety Logic is disclosed that guards against erroneous responses created by accidents or by accidental releases of submunitions of payloads being carried by explosive ordnances. The fuze safety logic provides provisions for conservation of battery internal power, while at the same time ensures the maintenance of proper safety features of the explosive ordnances.

2 Claims, 5 Drawing Sheets

GUN LAUNCH OR DROP/EXPELLED
82
BATTERY ACTIVATED
42
IS NEST SWITCH OPEN ?
44
YES
84
SELF DUD (SEE FIG.2B)
48
NO
90
START TIMER T=0
92A
100
NO
98
IS NEST SWITCH OPEN ?
44
YES
96
SELF DUD (SEE FIG. 2B)
48
94
IS T GREATER THAN 30 SEC. ?
92B
SEE FIG.2C
102

PROXIMITY SUBMUNITION FUZE SAFETY LOGIC

STATEMENT OF GOVERNMENT INTEREST

The invention described herein was made by an employee of the United States Government and may be used by or for the government for governmental purposes without the payment of any royalties thereon or therefor.

BACKGROUND OF THE INVENTION 1.0 Field of the Invention

This invention relates to a submunition of a projectile having a fuzed warhead and, more particularly, to a submunition that provides an explosive ordnance with provisions for conservation of its internal battery power or power source, a programmable timer for controlling its self-destruct/neutralizer functions, and other programmable timers that ensure the maintenance of the proper safety features of the explosive ordnance.

2.0 Description of the Prior Art

The U.S. Military is increasingly demanding that all explosive ordnances being developed incorporate a fuzing system, such as an electronic fuzing system, for neutralizing or otherwise self-destructing such explosive ordnance once they have completed their intended mission. The U.S. Military is also concerned that ammunitions, such as explosive ordnances, containing submunitions not release the submunitions under any accidental scenarios.

In accident scenarios, a battery or power source activation event or a submunition release event related to the post-launch system, may occur at the same time or within a few seconds of the primary accident event or a secondary event. The electronics may misinterpret either an accidental submunition release event or an accidental battery activation event causing the submunition to function or to start a self-destruct or self neutralize process thus causing the functioning of the explosive ordnance. It is of primary importance that an apparatus be provided that eliminates any accidental electronic functioning for submunitions that would otherwise cause damage from the explosion of the ordnance.

The U.S. Military is increasingly demanding that the lethality associated with the submunitions be improved. This improvement in the lethality may be accomplished by a known proximity functional mode. It is desired that an apparatus be provided that incorporates a proximity mode so as to not only increase the lethality of the operation of the submunitions, but also the reliability and safety of the submunitions by the introduction of this proximity functional mode.

OBJECTS OF THE INVENTION

It is a primary object of the present invention to provide an apparatus for controlling a post-launch sequence of an explosive ordnance having a fuzed head that substantially eliminates any accidental electronic arming or functioning of submunitions associated with the explosive ordnance.

It is an additional object of the present invention to provide for a proximity function mode used to control the operation of the submunitions of the explosive ordnance.

It is a further object of the present invention to provide safety logic inhibiting any erroneous functional responses of submunition fuze electronics after it is placed on its internal battery or power source.

It is a further object of the present invention to increase the lethality of the submunitions related to the explosive ordnance.

It is a further object of the present invention to increase the overall reliability of the submunitions which, in turn, increases the overall reliability of the projectile.

It is a further object of the present invention to conserve the internal power supply of the fuze, which increases the ability to use smaller batteries or power sources for powering the electronics associated with the submunition fuze which, in turn, reduces the size of the fuze.

It is still a further object of the present invention that allows for better control of the submunitions while still employing the control for the self-neutralization and self-destruct functions for the explosive ordnance.

SUMMARY OF THE INVENTION

The present invention is directed to an apparatus that provides an initiation system that controls an explosive ordnance while at the same time provides provisions for the conservation of the associated battery or power source, and provides provisions for programmable timers for setting the self-destructing and/or self-neutralizing functions, as well as other programmable timers that ensure the maintenance of the proper safety features of the explosive ordnance, especially those related to the submunitions of the explosive ordnance.

The apparatus of the present invention controls the submunition of a projectile having a fuzed warhead. The functioning or safely securing of a submunition is dependent upon the occurrence of a battery or power source activation control signal, the occurrence of both the presence and absence of a nesting switch open control signal, and the presence of a valid target control signal. The successful submunition functioning or safely securing is also dependent upon the generation of four commands, (1) self-dud, (2) charge firing capacitor, (3) turn on proximity mode, and (4) fire firing capacitor. The successful submunition functioning is also dependent upon the inhibiting of the self-dud command. The successful submunition being made safe is also dependent upon the activation of the self-dud command. The apparatus comprises a microprocessor having a plurality of routines and subroutines, preferably seven routines, with the seventh routine having three subroutines. The routines and subroutines of a microprocessor provide a method to conserve internal power for the explosive ordnance, while at the same time incorporate self-destruct/neutralizer timers and providing safety logic to eliminate responses to accidents involving submunitions.

BRIEF DESCRIPTION OF THE DRAWINGS

A better understanding of the present invention will be had upon reference to the detailed description when read in conjunction with the accompanying drawings in which.

DETAILED DESCRIPTION OF THE PREFERRED EMBODIMENTS

Figure 1:
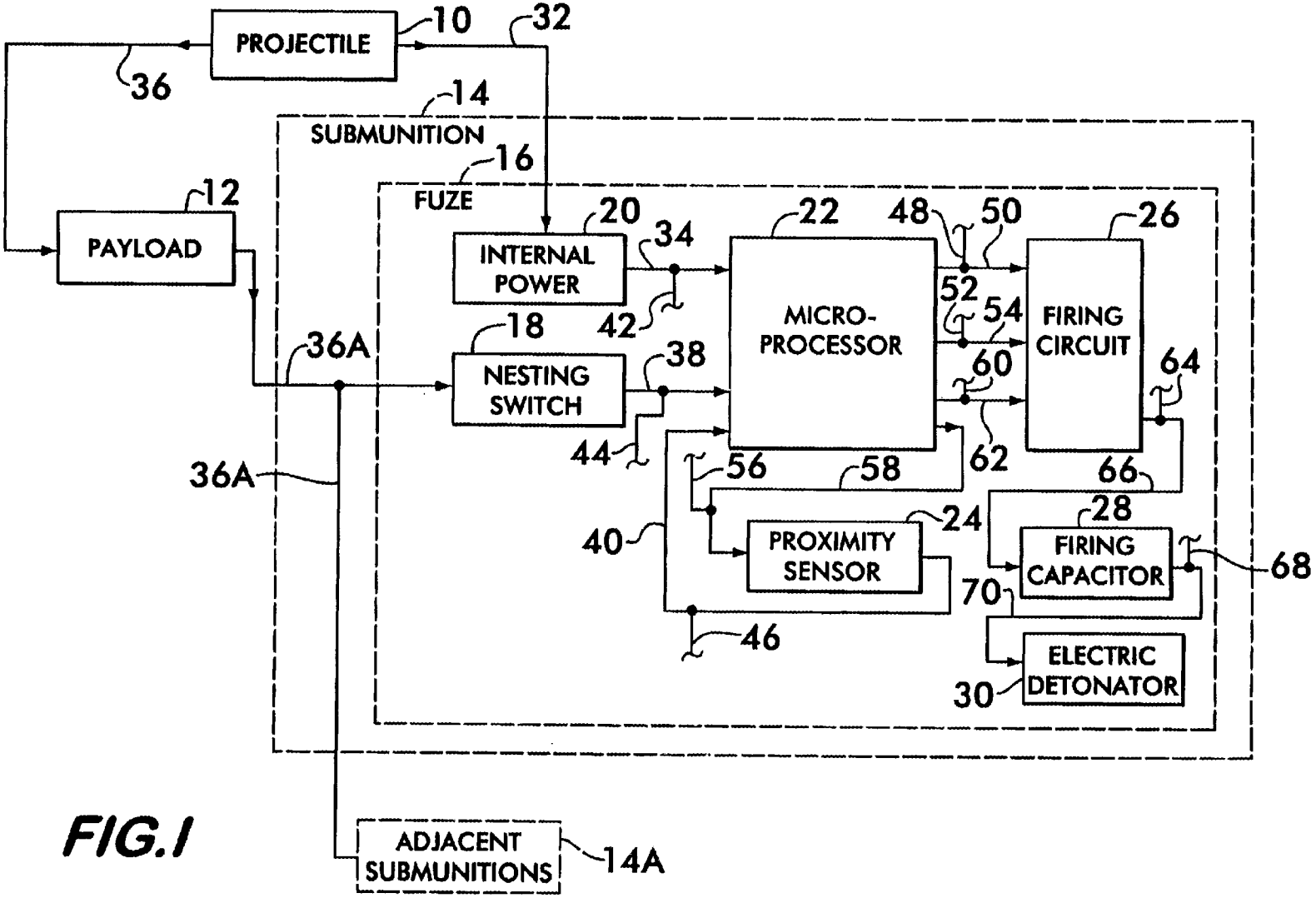
FIG. 1 is a block diagram that shows the interrelationship between the apparatus of the present invention and the payload and other submunitions.

With reference to the drawings, wherein the same reference number indicates the same element throughout there is illustrated in FIG. 1 a block diagram showing the elements associated with a projectile 10. The projectile 10 may be type known as Extended Range Guided Projectile (ERGM) which is fired from a naval gun. ERGM, among other sections, has an electronics section (not shown) and a payload section 12. The electronics section of ERGM causes the payload section 12 to be ejected from the projectile 10. Once free of the projectile 10, the payload section 12 ejects the submunitions, such as the submunitions 14 and 14A (Adjacent Submunitions) shown in FIG. 1. Each submunition 14 or 14A has a warhead (not shown) and a fuze 16. The present invention is particularly concerned with the logic within the electronics of the fuze 16 on the submunition 14. Except for the connection shown in FIG. 1 of the adjacent submunitions 14A connected to the nesting switch 18 of submunition 14, there is no electrical connection between the other submunitions or between the payload section or between the ERGM electronics.

The projectile 10 controls the launch of the payload 12 of the projectile, such as an explosive ordnance, to a predetermined target. The payload 12 releases the submunition 14, which contains the fuze 16. As shown as being arranged in FIG. 1, the fuze 16 contains the nesting switch 18, an internal battery or power source 20, a microprocessor 22 and other electronic components, a proximity sensor 24, and a firing circuit 26 which controls a firing capacitor 28 which, in turn, controls an electric detonator 30.

The microprocessor 22 eliminates any electronic reaction of the submunition 14 to an accidental release by the payloads or an accident involving the payload. Without the present invention, these accidental releases may interfere with the intended purpose of the explosive ordnance, that is, the submunitions of the payload being carried by the payload.

The submunition 14 is known in the art and may be of the type known as M80 grenade or EX 433 Proximity Fuze or M234 Self-Destruct Fuze. The projectile 10 functions in such a way as to cause, via signal path 32, activation of the internal battery or power source 20, thus supplying a signal on signal path 34 in the form of power to the microprocessor 22. The projectile 10 also acts in such a way as to cause the payload 12, via signal path 36, to generate a release signal on signal path 36A to the submunition 14 and adjacent submunitions 14A. The release signal causes the nesting switch 18 to supply an open signal on signal path 38, which is sent to the microprocessor 22. The microprocessor 22 in response to the two control signals 42 (battery activation), and 44 (nest switch open), on signal paths 34, 38, respectively, to be further described with reference to FIG. 2, provides four output commands which are (1) self-dud 48 on signal path 50, or (2) charge firing capacitor 52 on signal path 54, or (3) turn on proximity mode 56 on signal path 58, and or (4) fire firing capacitor 60 on signal path 62, with the signals 48, 52 and 60 being fed to the input stage of the firing circuit 26. The proximity sensor 24 detects a target and correspondingly sends a valid target signal on signal path 40 to the microprocessor 22. The microprocessor 22 in response to control signal 46 (valid target control) on signal path 40 provides output command fire firing capacitor 60 on signal path 62 with the fire firing capacitor signal 60 being fed to the input stage of the firing circuit 26. Firing circuit 26 generates an output signal 64 on signal path 66 that is routed to firing capacitor 28 which, in turn, generates an output signal 68 on signal path 70 which is routed to electric detonator 30.

The internal battery 20 of the fuze 16 supplies the battery activation signal 42, on signal path 34, which powers up the electronics of the fuze 16 including the microprocessor 22. The nest switch open signal 44 on signal path 38 indicates to the microprocessor 22 that the associate munition has been released from the adjacent submunitions 14A. The valid target control signal 46 on signal path 40 indicates that the radar proximity sensor has acquired a valid target. The self-dud subroutine 72 being run in the microprocessor 22 ensures the submunition 14 will not be capable of electrically detonating the system. Charge firing capacitor subroutine 74 being run in the microprocessor 22 indicates to the electronics that is, firing circuit 26, to output signal 64 on signal path 66 to the firing capacitor 28. Turn on proximity mode routine 76 being run in the microprocessor 22 indicates to the microprocessor 22 to broadcast a signal, look for a return signal, and then analyze the return signal for a valid target. The fire firing capacitor routine 78 being run in the microprocessor 22 causes the electronics to discharge the firing capacitor 28 connected to the electrical detonator 30, thus functioning the warhead. All of the routines 72, 74, 76 and 78 are to be further described hereinafter with reference to FIG. 2.

FIG. 2 is composed of FIGS. 2A, 2B, 2C, and 2D that cumulatively illustrate a flow chart that includes the identification of the input control signals 42, 44, and 46 of FIG. 1, as well as the command signals 48, 52, 56, and 60 of FIG. 1. The battery activation signal 42 is referred to in FIG. 2 as battery activated 42. Still further, the nesting switch open signal 44 is referred to in FIG. 2 as Nest Switch Open. Further, the signals 42, 44, 46, 48, 52, 56 and 60 of FIG. 1 are sometimes referred to as events in FIG. 2.

Figure 2A:
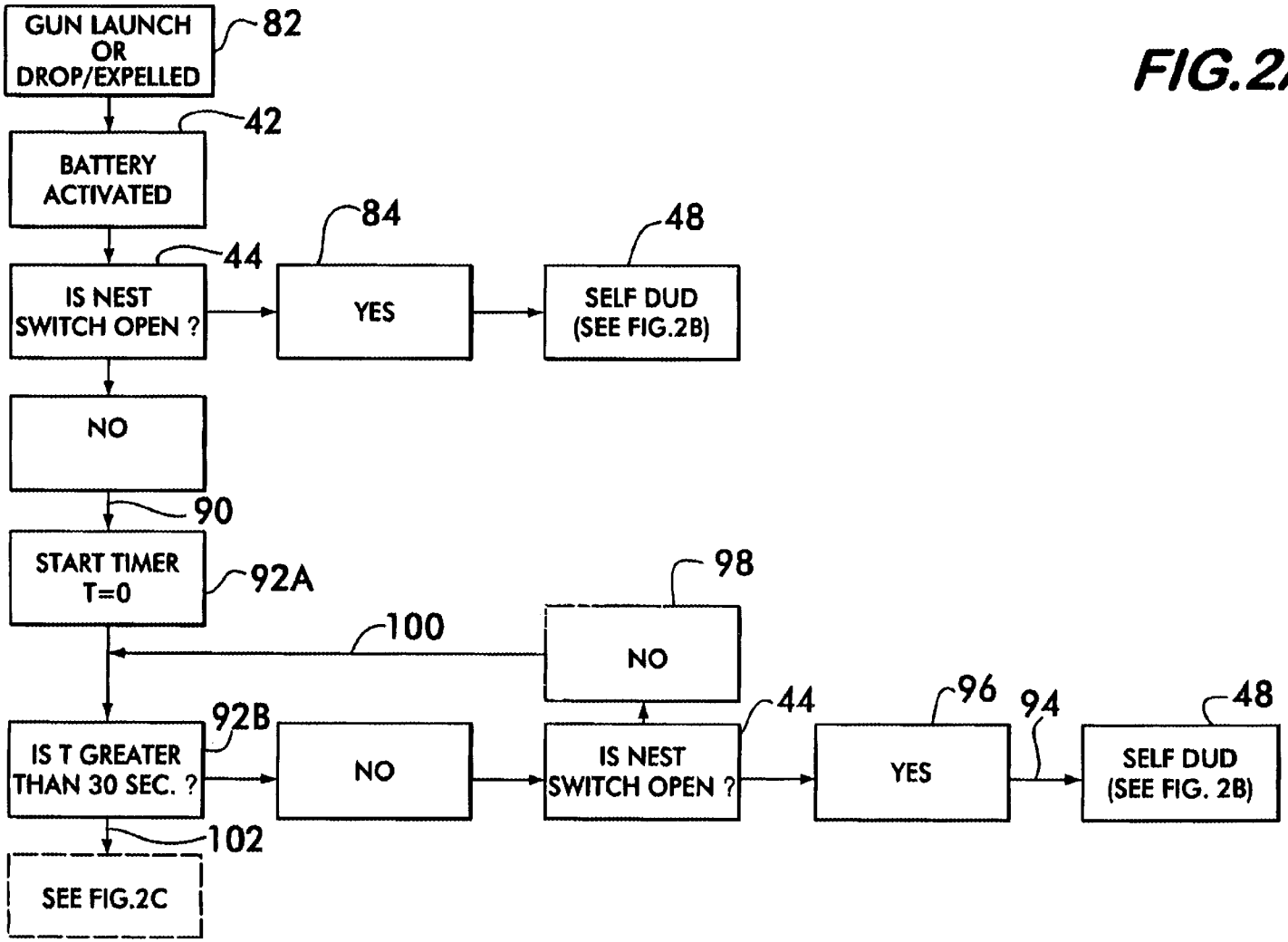
FIG. 2 is composed of FIGS. 2A, 2B, 2C and 2D that cumulatively illustrate a flow chart showing the overall operation of the safety logic related to the present invention.

A normal functional scenario, partially illustrated in FIG. 2A, has the internal battery 20 of the fuze 16 being activated by a signal on signal path 32 (see FIG. 1) at gun firing by a setback G-force or by having the associated payload being dropped or expelled from an explosive ordnance as represented by program segment 82. Program segment 82 creates the battery-activated event 42 which, in turn, is handled by a first routine residing in microprocessor 22.

The first routine is in response to the battery activated signal 42 and the nest switch open control signal 44 being present at the same time, indicated by program segment 84, generates the self-dud command 48 which, in turn, activates the self-dud subroutine 72, which may be further described with reference to FIG. 2B.

Figure 2B:
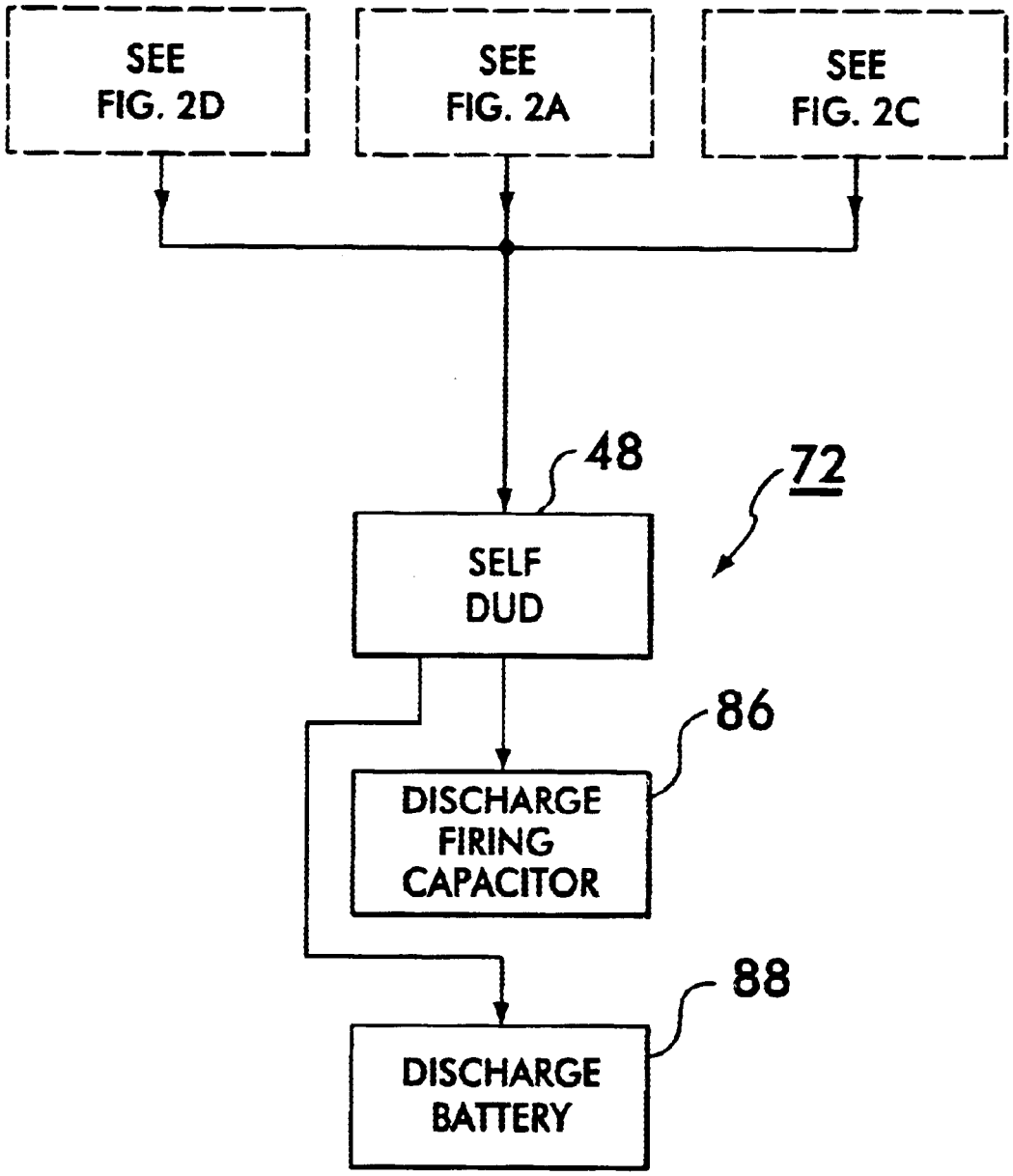

As seen in FIG. 2B, the self-dud subroutine 72 is initiated by the self-dud command 48 which causes a discharge firing capacitor event 86 to be created and also causes a discharge battery 88 event to be created. The events 86 and 88 are indicative of an abnormal situation. Both events together ensure that the submunition will not electrically function in the future, that is, will remain dormant. Furthermore, for this condition, the firing capacitor 28 of FIG. 1 does not release its energy to the electrical detonator 30. Although the self-dud subroutine 72 is preferred, the self-dud sequence can be any method that ensures the electronics of the fuze 16 do not cause the functioning of the explosives.

Under normal situations, the nest switch open event 44, shown in FIG. 2A, is not immediately present when the battery activated event 42 occurs so that the first routine generates a first output signal on signal path 90 which starts a second routine residing in the microprocessor 22.

The second routine is responsive to the first output signal on signal path 90, as well as to the present and absence of the nesting switch control signal represented by presence and absence of event 44. The second routine comprises three program segments 92A and 92B, and 92C (shown on FIGS.

2C and 2D) with program segment 92A starting a first timer t=0, with program segment 92B keeping track that a first predetermined maximum time for first timer t has not exceeded a typical value, such as 30 seconds, and program segment 92C keeping track that a second predetermined maximum time for the first timer, t, has not exceeded a typical value, such as 8 minutes. The second routine creates the self-dud command signal on path 94 of FIG. 2(A), which is at the output of program segment 96, upon the occurrence of the presence of the nest switch open event 44 before the predetermined maximum time (30 seconds) of the first timer controlled by program segment 92B expires. If the nest switch open event 44 is not present, the second routine returns to program segment 92B, by way of program segment 98 and signal path 100 as shown in FIG. 2A. Furthermore, if the nest switch open event 44 is not present before the 30 seconds has expired, the second routine generates a second output control signal on signal path 102, which is delivered to program segment 104 of the third routine which may be further described with reference to FIG. 2C.

Figure 2C:
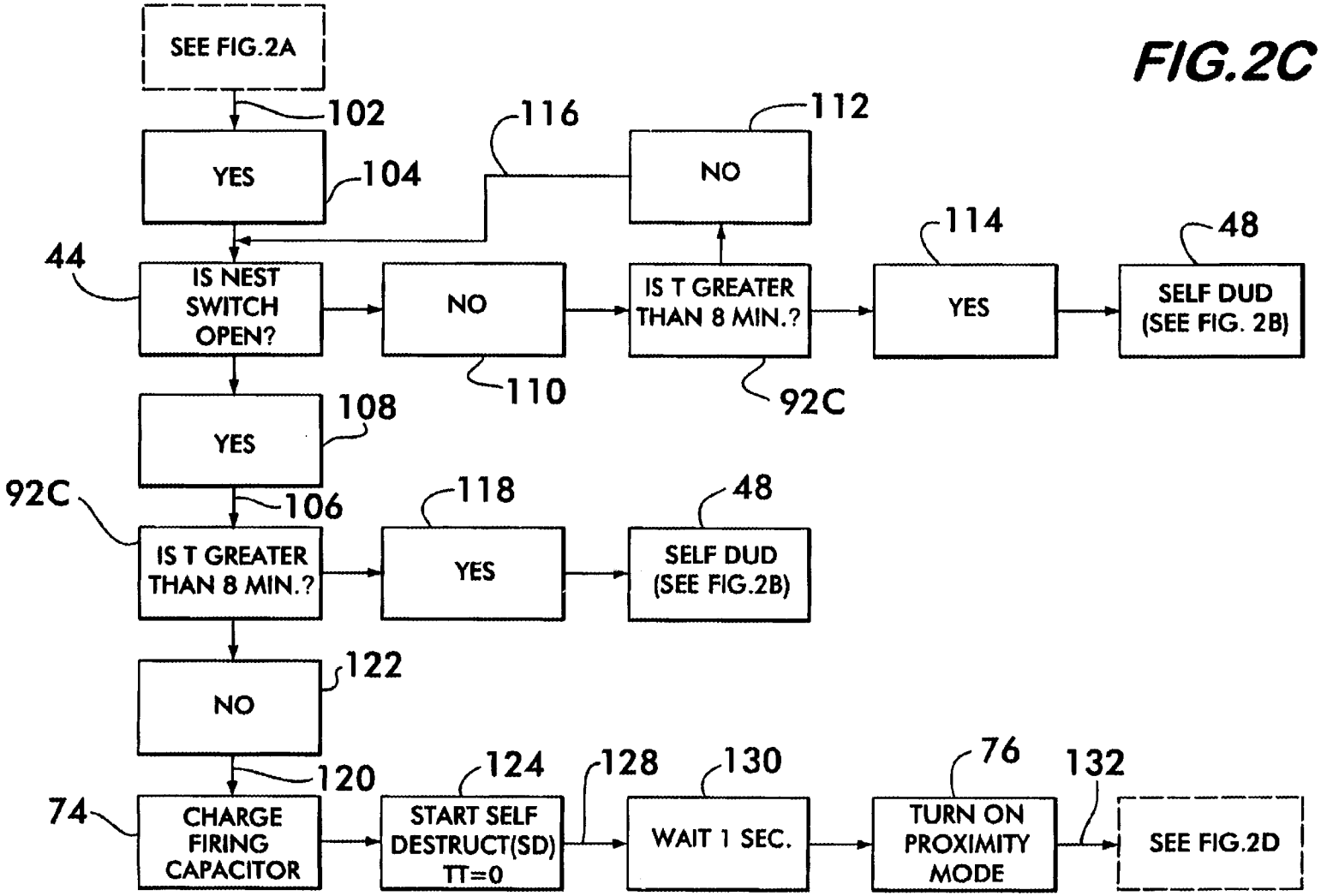

The third routine generates a third output signal present on signal path 106 in response to the nest switch open event 44 being present after the expiration of the 30 seconds controlled by program segment 92B of FIG. 2A. The third output signal on signal path 106 of FIG. 2C is generated by program segment 108. The third routine also includes program segments 110, 92C, 112 and 114 and the sensing of the self-dud command signal 48 which activates the self-dud subroutine 72, previously described with reference to FIG. 2C. More particularly, if the second output signal is present on signal path 102 and if the nest switch open event 44 is not (program segment 110) present, then the program segment 92C (Is T greater than 8 minutes?) is examined and if the answer of this examination is No (program segment 112) the third routine returns, via signal path 116 of FIG. 2C, to its event 44 for sensing for the nest open switch signal 44; however, if the 8 minutes, associated with program segment 92C has expired, program segment 114 causes the generation of self-dud command signal 48 and which, in turn, causes the response previously described with reference to FIG. 2B.

A fourth routine in response to the presence of the third output signal on signal path 106 causes the examination of program segment 92C. The fourth routine will generate the self-dud control signal 48 upon the expiration of the 8 minutes controlled by program segment 92C and by the activation of program segment 118, but it also generates a fourth output signal on signal path 120 if the predetermined maximum time of 8 minutes set by program segment 92C has not expired, as indicated by program segment 122. The fourth output is routed to charge firing capacitor subroutine 74, which is also part of a fifth routine.

The fifth routine, in particular, the charge firing capacitor subroutine 74 causes the firing circuit 26 of FIG. 1 to generate output signal 64 so as to supply voltage to the firing capacitor 28 in response to the fourth output signal on signal path 120. The fifth routine includes program segments 124 and 126, wherein program segment 124 starts a self-destruct (SD) timer TT=0, and wherein program segment 126 (shown in FIG. 2D) sets a predetermined maximum time for the self-destruct (SD) timer, which may have a typical timer value of 30 seconds. The fifth routine supplies a fifth output signal on signal path 128, which is routed to a sixth routine.

The sixth routine starts at a second timer, controlled by program segment 130 having a predetermined maximum time, which may be one (1) second and upon the expiration of the one (1) second duration, the second timer generates the command, turn on proximity mode signal 56 of FIG. 1, which is shown in FIG. 2C by event 76. The output of turn on proximity mode event 76 is routed to a seventh routine by way of signal path 132, which may be further described with reference to FIG. 2D.

Figure 2D:
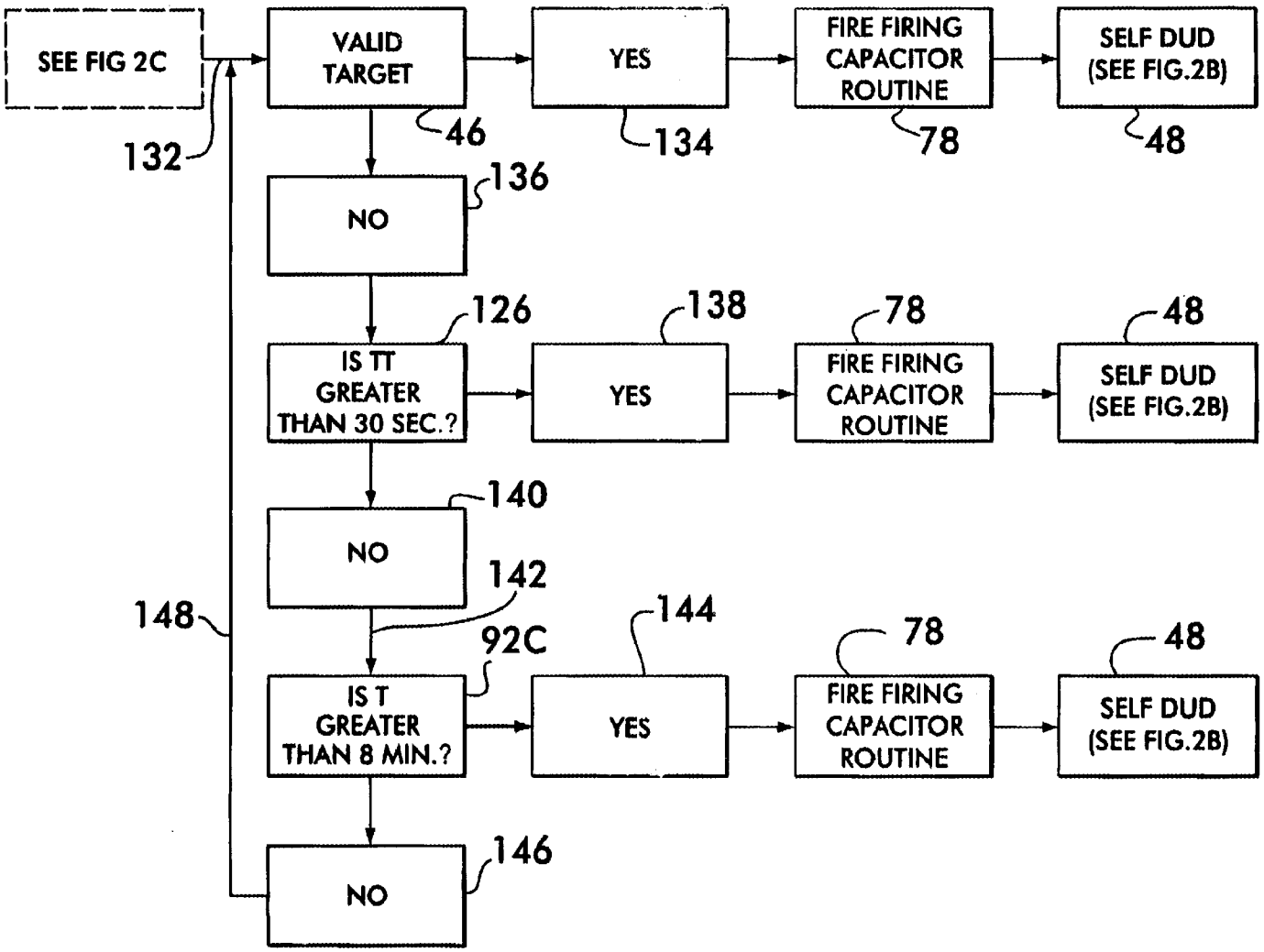

The seventh routine is responsive to the presence and absence of the valid target event 46 of FIG. 1, shown in FIG. 2D as event 46, and the expiration of the self-destruct (SD) timer (TT) controlled by program segment 126, previously mentioned with reference to the fifth routine of FIG. 2C. The seventh routine is also responsive to the presence and absence of the expiration of the second predetermined maximum time of the first timer, t, defined by program segment 92C previously discussed with regard to the second routine of FIG. 2A. The seventh routine includes three subroutines.

The first subroutine, in particular program segment 134, of the seventh routine generates the firing capacitor command signal 60 of FIG. 1 which, in turn, activates the fire firing capacitor routine 78 upon the presence of a valid target event 46. The fire firing capacitor routine 78 commands the firing circuit 26 to cause the discharge of the firing capacitor 28 connected to the electrical detonator 30. Further, the fire firing capacitor routine 78 causes the generation of the self-dud command signal 48.

The second subroutine of the seventh routine, in response to the absence of the valid target event 46 indicated by program segment 136, and the expiration of the 30 second timer for the self-destruct (SD) timer (TT) defined by program segment 126 and indicated by program segment 138, causes the activation of the fire firing capacitor routine 78 and the generation of the self-dud command signal 48. The second subroutine, in particular program segment 140, generates an output signal on signal path 142 upon the absence of a valid target control event 46 and upon the absence of the expiration of the 30 second for the self-destruct (SD) timer (TT) defined by program segment 126.

The third subroutine of the seventh routine, in particular program segment 144, activates the fire firing capacitor routine 78 in response to the output signal being present on signal path 142, and upon the expiration of the maximum time (8 minutes) controlled by program segment 92C. The fire firing capacitor routine 78 also causes the generation of the self-dud command 48. If the maximum time, typically 30 seconds, for the self-destruct timer, TT, controlled by program segment 126 has not expired indicated by program segment 140, and if 8 minutes predetermined second maximum duration of the timer, t, of program segment 92C has also not expired indicated by program segment 146, then the third subroutine of the seven routine transfers control back to the first subroutine of the seven routine starting at the valid target event 46 by way of signal path 148.

It should now be appreciated that the practice of the present invention in response to a normal function scenario that has a battery activated at gun firing by the setback G-force indicated by event 82 of FIG. 2A, provides a program safety logic that allows 30 seconds, controlled by program segment 92B, for a minimum flight. This 30 seconds may typically be increased to 45 seconds. The maximum flight time for the projectile 10 is 8 minutes and is controlled by program segment 92C of FIGS. 2C and 2D. Thus, the fuze control logic mandates that the submunitions remain nested together for at least 30 seconds after the battery is activated, but allows for up to 8 minutes for unnesting to occur. Accounting for typical battery rise time and electronic timer tolerances, these times may be adjusted between 30 to 45 seconds and between 8 to 10 minutes. It should also be appreciated that programmable timers are ordnance dependent and can be changed to match different performance requirements.

It should be further appreciated that the present invention provides for a proximity fuze mode. The proximity fuze mode, that is, turning on the proximity sensor 24, shown in FIG. 2C, is coordinated with the valid target information indicative that the correct height of the explosive ordnance has occurred prior to ground impact. This allows the submunition to be more lethal. Further, the integration of the timing logic with turning on the proximity fuze mode has allowed the battery capacity to be reduced by not requiring the proximity mode to be broadcasting considerable RF energy, which, in turn, allows for the reduction in size of the internal battery being carried by the explosive ordnance, which, in turn, allows for the reduction in size of the entire fuze. Further, the proximity mode not only increases the lethality, but also increases the reliability of the operation of the submunitions.

The present invention eliminates electronic functioning by any accidental release of the submunitions. More particularly, in an accident scenario, the battery activation event is considered to occur at the same time or within a few seconds of the submunition release event. It is assumed that if the submunitions are nested during this time, they will remain somewhat together for a sufficiently long time. The use of a programmable timer takes this into account and does not react immediately to the nest switch open signal 44. Although in an accident where the battery is activated and the submunitions are nested, the ability of the fuze control logic does not prevent the fuze to be functioned mechanical, but it does at the same time greatly reduce the probability of allowing for the entering of the self-destruct or self-neutralizing mode.

It will be apparent to those skilled in the art that various modifications and variations can be made in the above-described embodiments of the present invention without departing from the scope or spirit of the invention. Thus, it is intended that the present invention covers such modifications and variations provided they come within the scope of the appended claims and their equivalence.

What I claim is:

1. An apparatus for controlling the post-launch of a projectile having a fuzed warhead, said post-launch for a successful launch being dependent upon the receipt of the presence of a battery or power source activation control signal, the receipt of both the presence and absence of a nest switch open control signal and the presence of a valid target control signal, said successful post-launch also being dependent upon the generation of four (4) commands, (1) self-dud, (2) charge firing capacitor, (3) turn on proximity switch, (4) fire capacitor and also being dependent upon the inhibiting of the self-dud command, said apparatus comprising:

a microprocessor comprising:

(a) a first routine responsive to the battery activated and nest switch open control signals and generating said self dud command in response to the presence of both said battery activated and nest switch control signal and generating a first output signal upon the presence of said battery activated control signal and the absence of said nest switch open control signal;

(b) a second routine responsive to said first output signal and to the presence and absence of nest switch open control signal, said second routine starting a first timer having a first and second predetermined maximum times in response to said first output signal and generating said self dud command upon the occurrence of the presence of said nest switch open control signal before said first predetermined maximum time of said first timer expires and generating a second output signal upon the expiration of said predetermined maximum time of said first timer without the occurrence of the presence of said nest switch open control signal;

(c) a third routine generating a third output signal in response to the second output signal and the presence of said nest switch open control signal, said third routine generating said self-dud command upon the absence of said nest switch open control signal and upon the expiration of said second predetermined maximum time of said first timer;

(d) a fourth routine generating said safe-dud command upon the expiration of said second predetermined maximum time of said first timer and the presence of said nest switch open control signal, but generating a fourth output signal during said second predetermined maximum time of said first timer;

(e) a fifth routine responsive to the fourth output signal and generating said charge firing cap command in response thereto and starting a self-destruct timer having a predetermined maximum time while at the same time generating a fifth output signal;

(f) a sixth routine starting a second timer having a predetermined maximum time in response to said fifth output signal and upon the expiration of said predetermined maximum time of said second timer generating said turn on proximity switch command;

(g) a seventh routine responsive to the presence and absence of said valid target control signal, the presence and absence of the expiration of said second predetermined maximum time of said first timer and the presence and absence of the expiration of said self-destruct timer, said seventh routines having three subroutines comprising:

(i) said first subroutine generating said fire capacitor command upon the presence of said valid target control signal;

(ii) said second subroutine generating said fire capacitor command upon the absence of said valid target control signal and the presence of the expiration of said self-destruct timer and generating an output signal upon the absence of said valid target control signal and the absence of said expiration of said self-destruct timer; and (iii) said third subroutine generating said fire capacitor command signal in response to the output signal of said second subroutine and the presence of the expiration of said second predetermined maximum time of said first timer.

2. The apparatus according to claim 1, wherein said first and second predetermined maximum times of said first timer are about 30 seconds and 8 minutes respectively, said maximum time of said second timer is about one (1) second, and said maximum time of said self-destruct timer is about 30 seconds.

* * * * *